US005194064A

United States Patent [19]

Simpson et al.

[11] Patent Number: 5,194,064

[45] Date of Patent: Mar. 16, 1993

[54] CREASING RULE FOR ROTARY DIE APPARATUS

[75] Inventors: Jack R. Simpson, Raleigh; Jeffrey A. Geer, Apex, both of N.C.

[73] Assignee: Container Graphics Corporation, Cary, N.C.

[21] Appl. No.: 920,253

[22] Filed: Jul. 27, 1992

[51] Int. Cl.[5] ..... B31B 1/25

[52] U.S. Cl. ..... 493/402; 493/403; 493/471; 83/879

[58] Field of Search ..... 493/396, 397, 400, 401, 493/402, 403, 60, 61, 471; 83/879

[56] References Cited

U.S. PATENT DOCUMENTS

| | | | |
|---|---|---|---|
| 659,246 | 10/1900 | Mayall . | |
| 937,331 | 10/1909 | Reed . | |
| 1,136,795 | 4/1915 | Graham . | |
| 1,196,956 | 9/1916 | Kelleher . | |
| 1,223,254 | 4/1917 | Burks . | |
| 1,373,668 | 4/1921 | Pearsall . | |
| 1,414,549 | 5/1922 | Cleary . | |
| 1,607,900 | 11/1926 | McColm . | |
| 2,029,394 | 2/1936 | Sidebotham . | |
| 2,099,936 | 11/1937 | Kieckhefer . | |
| 2,139,890 | 12/1938 | Fitchett . | |
| 2,223,503 | 12/1940 | Wilson . | |
| 2,475,868 | 7/1949 | Anderson . | |
| 2,485,020 | 10/1949 | Staude . | |
| 2,830,506 | 4/1958 | Burroughs . | |
| 3,074,324 | 1/1963 | Nobbe | 93/1.1 |
| 3,137,217 | 6/1964 | Elliott | 93/36 |
| 3,318,206 | 5/1967 | Kuehn et al. | 93/58.1 |
| 3,443,489 | 5/1969 | Watkins | 93/58.1 |
| 3,673,929 | 7/1972 | Saunders | 93/58.2 R |
| 3,746,593 | 7/1973 | Majewski et al. | 156/207 |
| 3,866,523 | 2/1975 | Geschwender | 93/58 ST |
| 4,289,492 | 9/1981 | Simpson | 493/371 |
| 4,563,930 | 1/1986 | Schommler et al. | 83/862 |
| 4,596,541 | 6/1986 | Ward Sr. et al. | 493/59 |

*Primary Examiner*—Bruce M. Kisliuk
*Assistant Examiner*—Jack Lavinder
*Attorney, Agent, or Firm*—Bell, Seltzer, Park & Gibson

[57] ABSTRACT

The creasing rule includes elongate creasing members that extend outwardly from opposite sides of a central axis of the rule. The creasing members on each side of the rule are spaced laterally from each other and are in staggered, non-aligned relationship with the creasing members upon the opposite side of the rule's axis. Each creasing member has a relatively tall head section adjacent the rule axis, and decreases in height between the head section and the opposite end of the member. The members preferably are formed of durable plastic material and are so mounted upon the die board of the rotary die apparatus as to be quickly and easily replaced when desired. Head sections of the creasing elements form a relatively wide and deep primary crease in the paperboard material of the panel, and medial and end sections of the creasing members simultaneously form secondary creases that extend outwardly from opposite sides of the primary crease.

15 Claims, 3 Drawing Sheets

CREASING RULE FOR ROTARY DIE APPARATUS

FIELD OF THE INVENTION

This invention relates to rotary die apparatuses for shaping and otherwise processing corrugated paperboard material used in the manufacture of components of cartons, boxes and the like. The invention more specifically relates to an improved creasing rule for a rotary die apparatus.

BACKGROUND OF THE INVENTION

The creasing rules customarily carried by the die roll of a rotary die apparatus are quite narrow and project only a limited distance beyond the arcuate outer surface of the die board of the die roll. Due to the highly localized nature of the forces imposed upon the paperboard material by the narrow rules, they frequently cut and/or crack the paperboard material, instead of merely forming a crease or fold line. The crease or fold line formed by the rule is of course of correspondingly narrow width. Consequently, when sections of the paperboard material upon opposite sides of the fold line undergo relative pivotal movement toward each other, they quickly abut and resist further pivotal movement. This may and likely will cause the fold line to "wander," rather than being substantially straight, and/or may cause the presence of "phantom" fold lines that are spaced laterally from and that extend generally parallel to the intended fold line. Cutting and cracking of the paperboard material, wandering of the intended fold line and the creation of phantom fold lines each may weaken the strength of the paperboard material and/or may result in improper folding of the sections of the paperboard material upon opposite sides of the fold lines. This in turn causes the production of defective cartons or boxes from the paperboard material.

SUMMARY OF THE INVENTION

The creasing rule of the present invention minimizes if not altogether eliminates the above-discussed deficiencies of the narrow creasing rules customarily employed in rotary die apparatuses. More specifically, the creasing rule of the present invention performs its creasing functions with little if any undesirable cutting or cracking of the paperboard material, wandering of the fold line or generation of "phantom" fold lines. In a preferred embodiment thereof, the creasing rule is comprised of a plurality of elongate creasing elements that extend laterally outwardly from a central axis of the rule. Each creasing element has a relatively tall head section adjacent the end thereof closest to the central axis of the rule, and decreases in height between the head section and the outer end of the element. The creasing elements on each side of the central axis of the rule are spaced laterally from each other and extend in staggered non-aligned relationship to the creasing elements upon the opposite side of the rule axis. The head sections of the creasing elements upon one side of the axis preferably are in closely adjacent, and preferably laterally abutting, relationship to the head sections of the creasing elements upon the other side of the axis, and collectively form a central rib of the rule. In order to facilitate replacement of a creasing element that has been damaged or that otherwise might not be performing satisfactorily, the creasing elements may be secured to the die board of the die roll of the apparatus by means permitting rapid removal of them when desired. In one embodiment such means includes mating male/female components upon the die board and the elements. The releasable securing means may alternatively or additionally include staples or similar removable fasteners. The rule elements may be of solid construction or may have openings which impart resilience to them.

DESCRIPTION OF THE PRIOR ART

The following U.S. patents may be of interest relative to the invention: U.S. Pat. Nos. 659,246, 937,331, 1,136,795, 1,196,956, 1,223,254, 1,373,668, 1,414,549, 1,607,900, 2,029,394, 2,099,936, 2,139,890, 2,223,503, 2,475,868, 2,485,020, 2,830,506, 3,074,324, 3,137,217, 3,318,206, 3,443,489, 3,673,929, 3,746,593, 3,866,523, 4,289,492, 4,563,930 and 4,596,541.

DESCRIPTION OF THE DRAWINGS

Other features of the invention will be apparent from the following description of illustrative embodiments thereof, which should be read in conjunction with the accompanying drawings, in which.

DESCRIPTION OF THE ILLUSTRATED EMBODIMENTS

Figure 1:
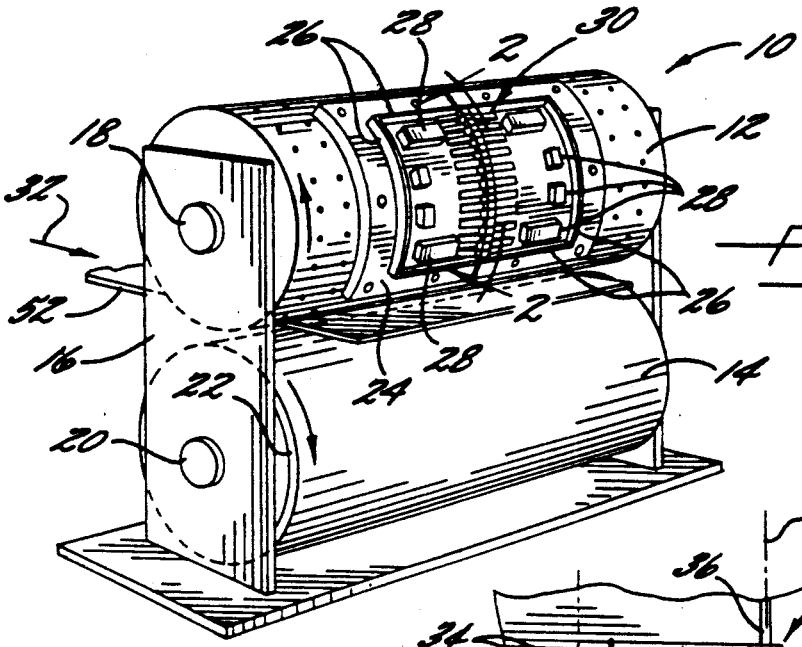
FIG. 1 is a partially schematic perspective view of die and anvil rolls of a rotary die apparatus having a creasing rule in accordance with the invention, and also showing a leading edge portion of a corrugated paperboard panel passing through the nip between such rolls.

The rotary die apparatus 10 schematically shown in FIG. 1 includes die and anvil rolls 12, 14 mounted by suitable framework 16 and shafts 18, 20 in closely spaced parallel relationship to each other for rotation in the opposite directions indicated by the arcuate arrows of FIG. 1.

As is customary, anvil roll 14 has a layer 22 of urethane upon its outer surface, and die roll 12 has an arcuate die board 24 secured by suitable fasteners to its outer surface. While die board 24 might and customarily would have additional components upon it for shaping corrugated paperboard material passing through the nip between rolls 10, 12, the illustrated components include conventional cutting rules 26, blocks 28 of ejection rubber, and a creasing rule 30 in accordance with the present invention.

Figure 2:
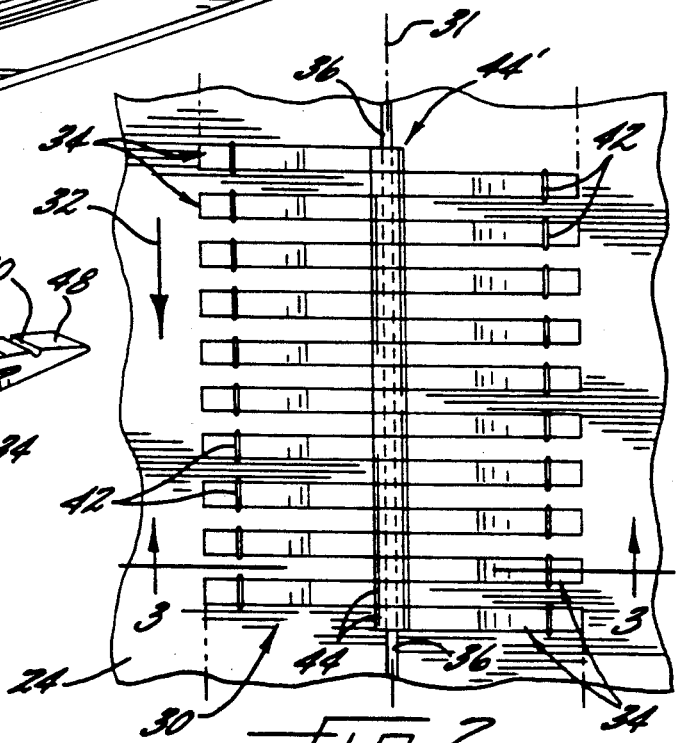
FIG. 2 is an enlarged fragmentary plan view taken in the direction of the arrows 2—2 of FIG. 1 of the creasing rule and the underlying die board of the die roll of the apparatus.
Figure 4:
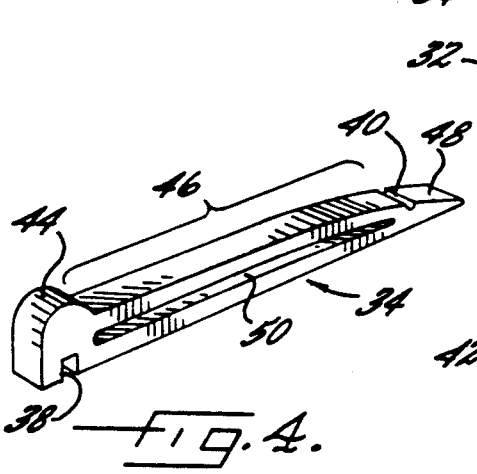
FIG. 4 is a perspective view of one of the creasing members of the creasing rule.
Figure 3:
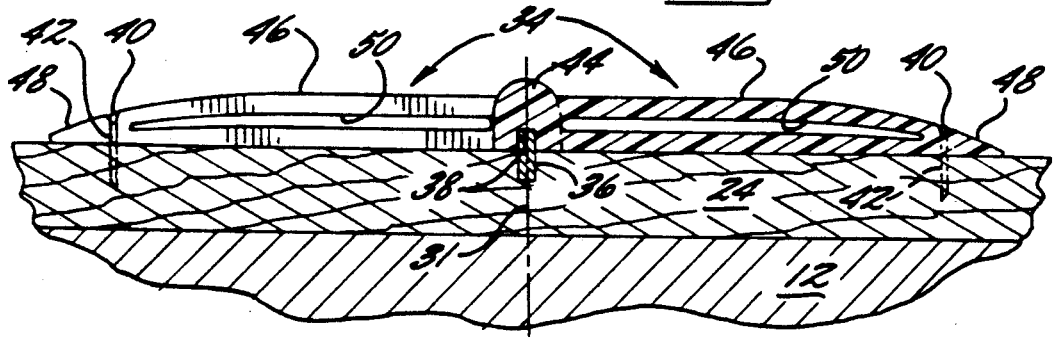
FIG. 3 is an enlarged view partially in elevation and partially in section taken along the line 3—3 of FIG. 2 through the creasing rule and adjacent portions of the die board and die roll.

In the illustrative embodiment of FIGS. 1 and 2, a central axis 31 of rule 30 extends substantially parallel to the machine direction (indicated by the arrow 32) of apparatus 10 and the rule includes a plurality of discrete elongate creasing members 34 that extend outwardly from opposite sides of axis 31 of rule 30. While they might be formed of wood, metal or other material, members 34 preferably are formed of durable plastic material. Each creasing member 34 has a relatively tall head element that is adjacent axis 31 and the inner end of the element. It also has adjacent its inner end portion and within its undersurface a groove 38 that closely receives the upper part of a mounting strip 36 that extends generally parallel to rule axis 31 and projects radially from die board 24. Adjacent its opposite, outer end portion each creasing member 34 has a groove 40 within its upper surface that receives a U-shaped staple 42 (FIG. 3) or similar removable fastener that projects into die board 24. Strip 36 and staples 42 secure members 34 to the outer surface of die board 24 but permit rapid substitution of another member 34 for one that has been damaged or that for any other reason should be replaced.

The height of each creasing member 34 decreases from its inner end portion to its outer end portion. More specifically, each creasing member 34 of FIGS. 1–5 includes a primary crease-forming head section 44 having an outer surface, illustratively of arcuate shape, that is disposed the greatest distance from die board 24; a medial section 46 having a generally flat outer surface of lesser height than head section 44; and an outer end section 48 having an arcuate outer surface that slopes toward, and illustratively to, die board 24. Each creasing member 34 preferably and illustratively also includes an elongate opening 50 that extends laterally through and between opposite sides of the member, and longitudinally from a location adjacent section 44 to a location adjacent section 48 of the member. Opening 50 permits spring-like flexure of the upper surfaces of sections 46 of members 34 during passage of rule 30 with a paperboard panel through the nip between the die and anvil rolls of apparatus 20.

The overall length of each creasing member 34 is much greater, illustratively about eight times greater, than the dimension in the same direction of its head section 44.

Figure 5:
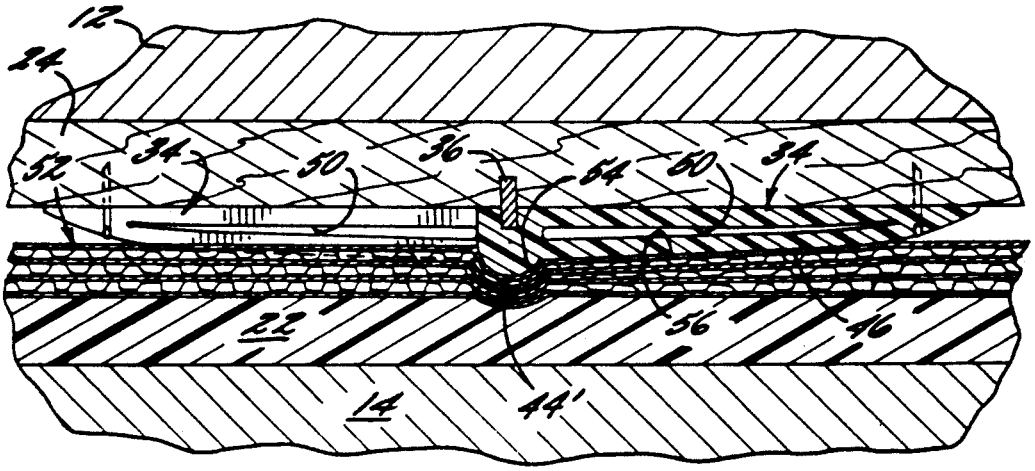
FIG. 5 is a fragmentary view partially in elevation but primarily in vertical section taken through the nip between the die and anvil rolls of the apparatus, and through a corrugated paperboard panel and components of the creasing rule passing between the die and anvil rolls.

The creasing members 34 upon each side of rule 30 are spaced laterally from each other, and are in non-aligned offset relationship to the creasing members upon the opposite side of rule 30. The opposite sides of head sections 44 of members 34 upon one side of rule 30 are laterally adjacent, and preferably abut, the confronting sides 44 of the head sections of the members 34 upon the opposite side of rule 30 so that they collectively form a central rib 44' of creasing rule 30. During operation of apparatus 10, rib 44' of rule 30 engage the proximate surface of a corrugated paperboard panel 52 passing through the nip between die and anvil rolls 12, 14 and forms in the panel a relatively wide and deep primary crease 54. The depth of crease 54 is attributable in substantial part to the fact that rib 44' not only compacts the corrugated paperboard material within the area of crease 54, but also drives the compacted paperboard material into the urethane layer 22 of anvil roll 14 to such an extent that some of the compacted paperboard of panel 52 is disposed below the plane of the layer's nominal upper surface, as shown in FIG. 5.

At the same time as rib 44' of creasing rule 30 forms primary crease 54, the medial and outer sections 46, 48 of creasing members 34 form a plurality of secondary creases 56 that extend laterally outwardly from, and preferably perpendicularly to, primary crease 54 on opposite sides thereof. The secondary creases 56 upon each side of primary crease 54 are spaced laterally from each other, and the creases 56 on opposite sides of primary crease 54 are in non-aligned relationship with each other. The depth of secondary creases 56 is much less than the depth of the primary crease 54 and decreases adjacent the outer ends of creases 56 to approximately zero. The length of creases 56 is commensurate with the combined lengths of medial and outer sections 46, 48 of creasing members 34. For reasons not entirely completely understood, the forces imposed upon panel 52 by the medial and outer sections of creasing members 34, and/or the creases 56 resulting from such forces, contribute significantly to the previously-noted elimination or at least minimization of cracking and tearing of the paperboard panel, and/or formation of "phantom" creases in the panel, as primary crease 54 is formed.

Figure 6:
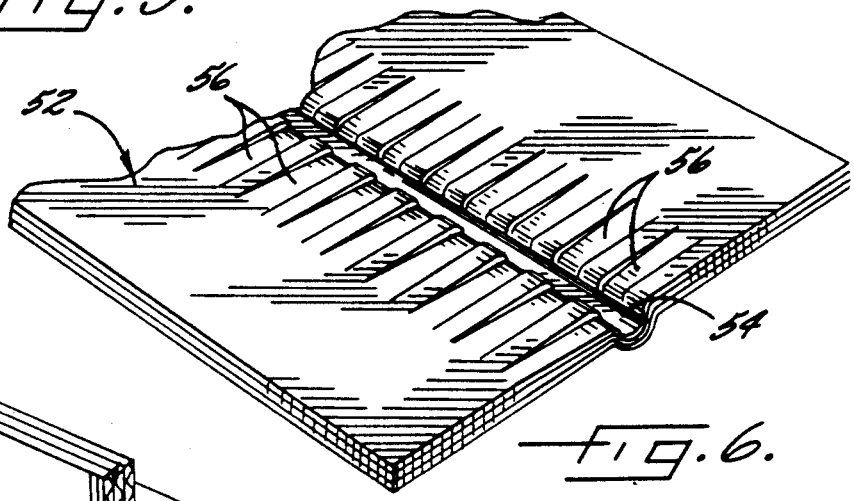
FIG. 6 is a fragmentary top perspective view of a paperboard panel having creases formed by the creasing rule.
Figure 7:
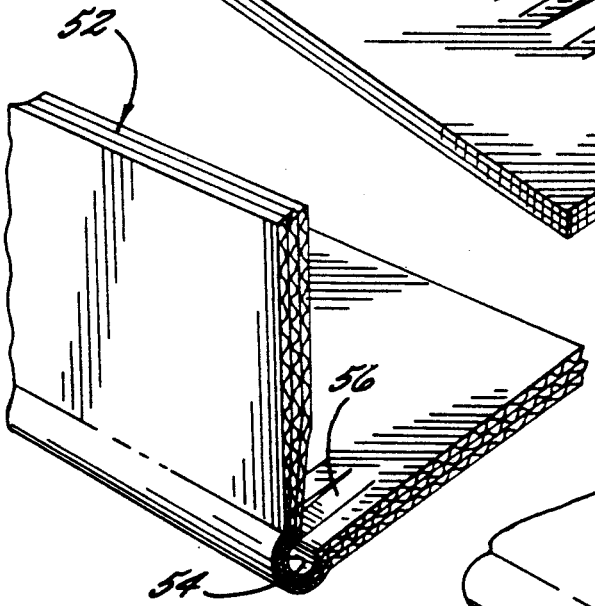
FIG. 7 is an end view of the FIG. 6 panel folded approximately 90°.
Figure 8:
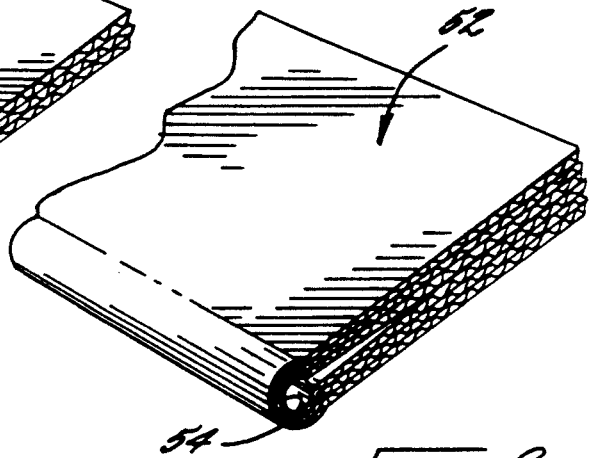
FIG. 8 is a fragmentary end view of the FIG. 6 panel folded approximately 180°.

As is best shown in FIG. 6, the secondary creases 56 upon each side of primary crease 54 are aligned with uncreased, and therefore relatively elevated, sections of panel 52 upon the opposite side of primary crease 54. Due to the size of primary crease 54 folding of the sections of panel 52 upon opposite sides of it occurs freely through not only 90°, as shown in FIG. 7, but also through 180°, as shown in FIG. 8. As will be recognized by those skilled in the art, the aforesaid free folding movement of the panel, particularly through 180°, is highly unusual and desirable since it results in the imposition of less stress upon the paperboard material, and the elimination of "wandering" and "phantom" creases.

Figure 9:
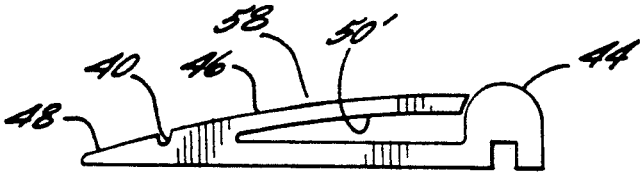
FIG. 9 is a side elevational view of a creasing member of a second construction.
Figure 10:
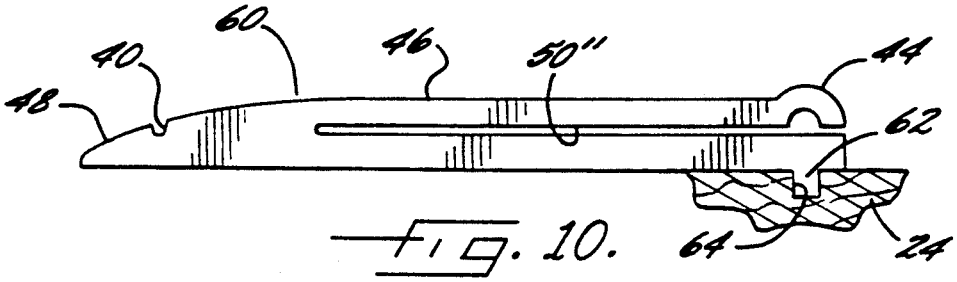
FIG. 10 is a side elevational view of a creasing member of a third construction, a fragmentary part of the die board also being shown in vertical section.

FIGS. 9 and 10 of the drawings illustrate alternative embodiments of elements of the creasing rule. The creasing rule member 58 of FIG. 9 differs from the creasing member 34 in that the medial section thereof overlying its opening 50' terminates short of its head section 44. This of course increases the flexibility of the medial section of creasing member 58. The creasing member 60 of FIG. 10 differs in that the medial and head sections thereof are integral with each other, and the opening 50'' in such member is smaller in a vertical direction than in the previously-discussed embodiments and extends to and through the head section 44 of member 60. Additionally, in the FIG. 10 embodiment a stud 62 projecting from the undersurface of member 60 is closely received within a mating opening 64 within die board 24, for the purpose of securing one end of member 60 to the die board.

Figure 11:
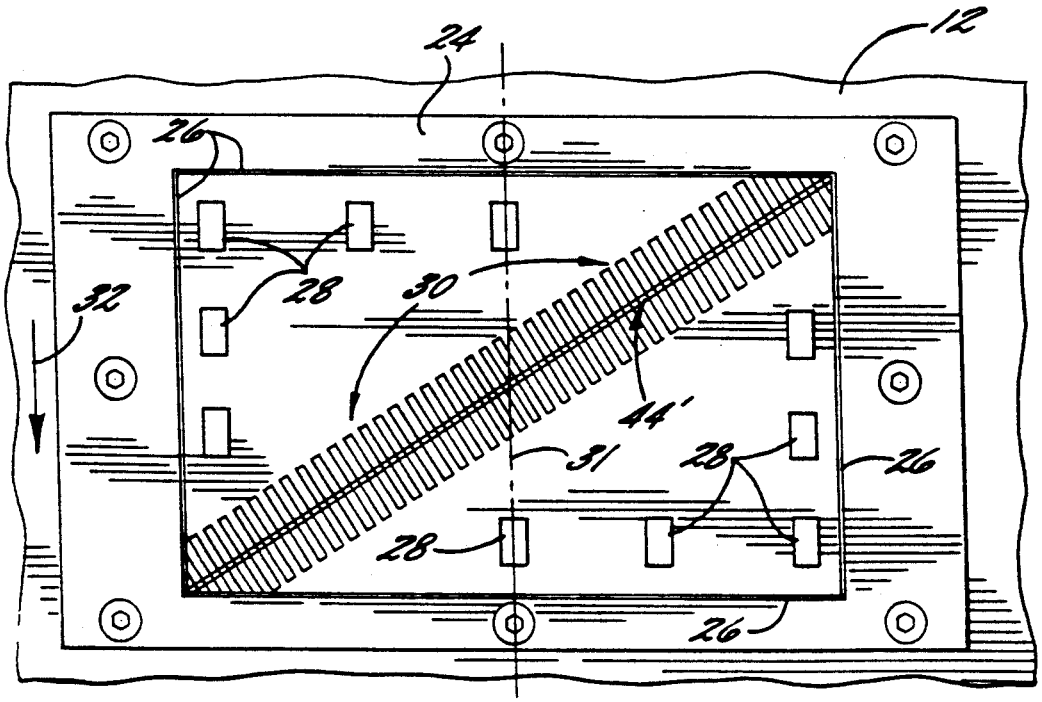
FIG. 11 is a top perspective view showing the creasing rule extending in oblique relationship to the machine direction of the rotary die apparatus.

FIG. 11 of the drawings illustrates that the creasing rule of the invention may extend in directions, such as the oblique direction shown in FIG. 11, other than in the machine direction of apparatus 10.

While illustrative embodiments of the invention have been shown and described, this was for purposes of illustration only, and not for purposes of limitation, the scope of the invention being in accordance with the following claims.

We claim:

1. A rotary die apparatus for processing corrugated paperboard, comprising:

a die roll and an anvil roll mounted in generally parallel relationship to each other for rotation in opposite directions and defining a nip therebetween;

an arcuate die board upon the outer surface of said die roll;

a layer of resilient deformable material upon the outer surface of said anvil roll;

a creasing rule mounted upon said die board of said die roll, said creasing rule having an elongate central axis and including a plurality of elongate creasing members extending laterally from said axis at spaced locations along the length thereof, each of said creasing members having a relatively tall head section adjacent said axis and an outer end section distal from said axis, said head section section of said creasing member having a greater height than said outer end section of said creasing member;

first ones of said creasing members being predominantly upon a first side of said axis and being spaced laterally from each other along said axis;

second ones of said creasing members being predominantly upon a second side of said axis and being spaced laterally from each other along the length of said axis; and said first ones of said creasing members being in staggered relationship with said second ones of said creasing members.

2. A rotary die apparatus as in claim 1, wherein said creasing members each include a medial section between said head section and said outer section.

3. A rotary die apparatus as in claim 2, wherein said head sections of said creasing members are in substantially aligned relationship with each other along the elongate central axis.

4. A rotary die apparatus as in claim 3, wherein said head sections of adjacent ones of said creasing members are in abutting relationship.

5. A rotary die apparatus as in claim 4, wherein said head sections of said creasing members are of arcuate shape.

6. A rotary die apparatus as in claim 1, wherein at least one of said creasing members has an interior opening intermediate the length of said member.

7. A rotary die apparatus as in claim 6, wherein said interior opening opens from at least one side surface of said creasing member.

8. A rotary die apparatus as in claim 6, wherein said interior opening opens from first and second opposite side surfaces of said creasing member.

9. A rotary die apparatus as in claim 6, wherein said opening opens from part of an upper surface of said creasing member.

10. A rotary die apparatus as in claim 6, wherein said interior opening underlies a medial upper section of said creasing member and permits spring-like flexure of said medial upper section.

11. A rotary die apparatus as in claim 1, and further including mating male and female mounting means for releasably securing said creasing members to said die board.

12. A rotary die apparatus as in claim 11, wherein each of said creasing members has an opening therein, and said mounting means includes a mounting member carried by and projecting from said die board and received within said openings of said creasing members.

13. Apparatus as in claim 11, wherein said mounting means includes a stud element connected to and extending downwardly from each of said creasing members, and at least one stud receiving opening in said die board.

14. Apparatus as in claim 13, wherein said mounting means further includes removable fastener elements engaging said creasing members and extending into said die board.

15. Apparatus as in claim 1, wherein said central axis of said creasing rule extends in oblique relationship to the machine direction of said rotary die apparatus.

* * * * *